US005947486A

United States Patent [19]

Zell

[11] Patent Number: 5,947,486

[45] Date of Patent: Sep. 7, 1999

[54] BIODYNAMIC ROLLER SKATE

[75] Inventor: Jürgen Zell, Mörschied, Germany

[73] Assignee: City Glider Product GmbH, Idar-Oberstein, Germany

[21] Appl. No.: 08/807,736

[22] Filed: Feb. 27, 1997

Related U.S. Application Data

[63] Continuation-in-part of application No. 08/544,429, Nov. 6, 1996, abandoned.

[30] Foreign Application Priority Data

| | | | |
|---|---|---|---|
| Nov. 4, 1994 | [DE] | Germany | 44 39 453 |
| May 23, 1996 | [DE] | Germany | 196 20 702 |
| Jul. 12, 1996 | [DE] | Germany | 196 28 185 |

[51] Int. Cl.[6] ..... A63C 17/00

[52] U.S. Cl. ..... 280/11.21; 280/11.28

[58] Field of Search ..... 280/11.19, 11.2, 280/11.21, 11.22, 11.27, 11.28, 842, 843, 87.03, 87.041, 7.13; 36/115

[56] References Cited

U.S. PATENT DOCUMENTS

| | | | |
|---|---|---|---|
| D. 146,368 | 2/1947 | McCaffrey | 280/11.19 |
| 332,278 | 12/1885 | Nelson et al. | 280/11.2 |
| 862,431 | 8/1907 | Armband | 280/843 |
| 918,575 | 4/1909 | Mees | 280/11.27 |
| 1,271,891 | 7/1918 | Gustin | 280/843 |
| 1,616,442 | 2/1927 | De Festenburg et al. | 280/843 |
| 1,975,905 | 10/1934 | Specht | 280/11.22 |
| 2,865,645 | 12/1958 | Levin | 280/11.2 |
| 2,944,827 | 7/1960 | Makara | 280/11.28 |
| 3,306,623 | 2/1967 | Weitzner . | |
| 3,339,936 | 9/1967 | Hamlin | 280/11.2 |
| 3,526,976 | 9/1970 | Jacobs | 36/115 |
| 3,963,251 | 6/1976 | Miano | 280/843 |
| 4,373,736 | 2/1983 | Stumbaugh | 280/11.27 |
| 4,412,685 | 11/1983 | Szamek | 280/11.19 |
| 4,657,265 | 4/1987 | Ruth | 280/11.27 |
| 4,691,453 | 9/1987 | Tifre | 280/843 |
| 4,838,564 | 6/1989 | Jarvis | 280/11.28 |
| 5,192,099 | 3/1993 | Riutta | 280/11.2 |
| 5,347,681 | 9/1994 | Wattron et al. | 280/11.27 |
| 5,388,350 | 2/1995 | Parker, Jr. | 280/11.19 |
| 5,392,537 | 2/1995 | Goldberg | 36/115 |
| 5,398,970 | 3/1995 | Tucky | 280/11.19 |
| 5,411,278 | 5/1995 | Wittmann | 280/11.22 |
| 5,540,455 | 7/1996 | Chambers | 280/11.28 |
| 5,634,648 | 6/1997 | Tonel et al. | 280/11.22 |

FOREIGN PATENT DOCUMENTS

| | | | |
|---|---|---|---|
| 432171 | 5/1854 | Belgium . | |
| 0 686 412 | 12/1995 | European Pat. Off. . | |
| 0 710 495 | 5/1996 | European Pat. Off. . | |
| 893707 | 10/1944 | France . | |
| 309567 | 3/1918 | Germany . | |
| 309567 | 10/1918 | Germany . | |
| 456796 | 3/1928 | Germany . | |
| 1117013 | 11/1961 | Germany . | |
| 2 250 201 | 4/1974 | Germany . | |
| 2 304 853 | 8/1974 | Germany . | |
| 7609251 | 6/1976 | Germany . | |
| 2736855 | 3/1979 | Germany | 280/11.22 |
| 23 21 669 | 6/1979 | Germany . | |
| 27 28 166 | 11/1979 | Germany . | |
| 28 21 644 | 11/1979 | Germany . | |
| 25 50 211 | 1/1983 | Germany . | |
| 87 11 944 | 2/1988 | Germany . | |
| 53-121975 | 9/1978 | Japan . | |
| 56-113572 | 9/1981 | Japan . | |
| 235827 | 6/1925 | United Kingdom . | |

*Primary Examiner*—J. J. Swann
*Assistant Examiner*—Frank Vanaman
*Attorney, Agent, or Firm*—Sixbey, Friedman, Leedom & Ferguson; David S. Safran

[57] ABSTRACT

A biodynamic roller skate with shoe (1) having sole (2) with front rollers (3) which are located in a forefoot area of the sole (2), and with rear rollers (4) which are located in a rear foot area of the sole (2). When the roller skate is used, all sections of the foot can be loaded individually, so that therapeutic treatment of the pes planovalgus deformity is possible. This becomes possible by the fact that sole (2) has a rigid front sole section (5), a flexible center sole section (6) and a rigid rear sole section (7).

33 Claims, 9 Drawing Sheets

BIODYNAMIC ROLLER SKATE

This application is a continuation-in-part of application Ser. No. 08/544,429, filed Nov. 6, 1996, abandoned.

BACKGROUND OF THE INVENTION

1. Field of the Invention

The invention relates to a biodynamic roller skate having a shoe with a sole located on the shoe, with front rollers which form a rolling surface and which are located in the forefoot area in sole, and with rear rollers which form a rolling surface and which are located in the rear foot area in sole.

2. Description of Related Art

From the published German Patent Application DE-A-28 21 644 on which the invention is based, a roller skate is known which is used not only in sports, but also is used for therapeutic treatment of muscle or bone deformations, and especially posture injuries to legs or feet. These posture injuries to the feet can, among others, be attributed to overly low training of the musculature of the feet.

Also, European Patent Application No. 0710 495 discloses a roller skate of the initially mentioned type in which the front sole section has a plurality of rollers to support the forefoot. This roller skate can be used not only in sports, but can also be used for therapeutic treatment when muscle or bone deformations and especially posture injuries to legs or feet occur. These posture injuries to the feet can among others be attributed to overly low training of the musculature of the feet. However, tests with the aforementioned roller skate have shown that it does not yet optimally imitate and support the natural progression of motion of the foot when walking.

In a healthy foot, the weight of the body is distributed on the foot proceeding from the hip joints via the knee down to the ankle joint. A healthy foot without anatomical deformations is loaded when standing with between 50% and 90% of the entire load on the heel bone and with between 10% and 50% of the entire load on the middle and forefoot area. When walking, the force which is distributed by the legs on the ankles is dynamically distributed on the forefoot. A healthy foot is, therefore, kept permanently under load by biodynamic equilibrium which is produced by the shape of the individual foot bones and by muscle traction.

Roughly 70% of the population has a so-called pes planovalgus deformity. Causes thereof are congenital weakness of the connective tissue, lack of foot training, continual walking on a hard floor and continual walking in hard shoes. The pes planovalgus deformity occurs in small children and is especially pronounced in adults. As is shown in FIG. 4*a*, the normal deviation of the rear foot axis from the vertical is from 0° to 6°. For pes planovalgus, this rear foot axis, however, deviates by more than 6° from the vertical, deviations of 10°, as is shown in FIG. 4*b*, with deviations of up to even 20° being possible. As a result of the inward inclination of the rear foot, the longitudinal arch of the foot also settles, by which a classical fallen arch is formed in which, while standing, almost the entire lower surface of the foot is in contact with the ground.

As a therapeutic measure in early childhood, pes planovalgus is counteracted with foot-gymnastic exercises. They include exercises in walking on tiptoes and walking on the heels, gripping exercises and extension exercises in the toe area. This previous pes planovalgus therapy by remedial gymnastic exercises generally comprises exercising once to several times a week with a remedial gymnastic therapist and furthermore daily exercising at home. However, these exercises have the disadvantage that they are not kept up over several years, on the one hand, the parents not having the necessary stamina, and on the other hand, the children themselves enjoy the exercises so little that, for this reason, due to resistance behavior caused thereby, further exercising is made impossible.

Another therapeutic measure for improving the arch of the foot is to provide tailored inserts. They are generally re-ordered semi-annually from the physician depending on the growth state of the foot and support the arch of the foot during the growth phase. This therapy is, however, a passive measure and does not promote the muscle growth responsible or co-responsible for the deformity, but in contrast allows the musculature to rest since the arch of the foot is additionally supported by the inserts.

As a therapeutic measure the roller skate mentioned initially can also be used since skating with roller skates, on the one hand, provides training for the leg and foot musculature, and on the other hand, provides interesting recreation for the children so that this therapy is also maintained over a longer time period.

The roller skates known from published German Patent Application Nos. DE-A-28 21 644, DE-A-23 04 853 and DE-A-22 50 201, and German Utility Model No. DE-U-87 11 944, have rigid soles. They inadequately consider the necessity of using the foot as a complicated organ for control. Instead, they are controlled essentially from thigh and the lower leg musculature. In particular, they do not allow selective loading of individual segments of the foot.

A roller skate is known (published German Application No. DE-B-1 117 013) in which the rollers are mounted by being inserted directly into the foot plate of the shoe which consists of the sole and heel. The foot plate consists of two parts which are interconnected via a center articulated area in a longitudinally adjustable manner, specifically a sole and a heel. Each part has a projecting flexible slide element which overlaps the two slide elements and are connected by an attachment screw, thus forming the articulated area. Thus, there is a flexible center sole section between the sole and heel. The skater moving with this roller skate, therefore, experiences a rolling motion in the foot which is similar to ordinary walking or running.

Also, this known roller skate with a flexible middle sole section has not yet been able to satisfy all requirements of therapeutic treatment of the pes planovalgus deformity in completed studies. That is, the vertical swivelling capacity of the rollers and the flexibility of the parts lead to a rather undefined progression of motion. The front rollers which are arranged on the corners of an equilateral triangle aligned symmetrically to the longitudinal axis of the roller skate cannot satisfactorily simulate the natural rolling behavior of the foot.

Finally, from the aforementioned general prior art of roller skates, it is known, of course, that in the rear foot area of the roller skate there can be a braking device with brake shoes which strike the road in order to allow active braking by the user.

SUMMARY OF THE INVENTION

In view of the above, this invention has a primary object of solving the problem of configuring and developing the initially explained, known roller skate such that, when using the roller skate, all sections of the foot can be loaded individually, so that therapeutic treatment of the pes planovalgus deformity is possible.

This object is achieved in a biodynamic roller skate having a shoe with a sole located on the shoe, with front rollers which form a rolling surface and which are located in the forefoot area in sole, and with rear rollers which form a rolling surface and which are located in the rear foot area in sole by providing the sole with a rigid front sole section and rigid rear sole section between which there is flexible middle sole section. The rigid front sole section essentially supports the surface of the forefoot and the rigid rear sole section essentially supports the surface of the rear foot.

The above indicated object is also achieved in a roller skate of the initially mentioned type by distributing the front rollers over an area of the bottom of the front sole section such that they establish an essentially triangular glide surface with a tip which points forward, the front roller which defines the tip being located essentially underneath the second and third toe, and especially under the second middle and this distal toe bone of a foot to be accommodated by a shoe. Futhermore, the two other front rollers are located essentially under first and fifth metatarsal capitulum of the foot to be received in the shoe, and define a rear edge of the triangular skating surface which is forwardly angled relative to a longitudinal axis of the shoe in a plane of the sole in a direction from the lateral side toward the medial side of the shoe.

It has been found that this triangular arrangement of the front rollers on the bottom of the front sole section is especially beneficial to the rolling behavior of the roller skate which is similar to natural walking. The rolling behavior of the roller skate is further improved by the fact that other two front rollers are essentially under the first and fifth metatarsal capitulum of the foot to be accommodated by the shoe.

In an especially preferred embodiment there are only three front rollers. This results in the rolling resistance being kept to a minimum so that almost natural walking or running with the roller skate according to the invention is possible.

A good equilibrium position is obtained especially by the fact that the front roller which defines the tip is located, with reference to the skating direction of the roller skate or in the case of a vertical twisting capacity of the rollers with respect to the longitudinal extension of the roller skate, in the middle between the two other front rollers and/or in the middle between the rear rollers.

To simulate largely a natural progression of motion it is advantageous if the rollers are integrated into the sole, therefore project in part into recesses so that the axes of rotation of the rollers lie essentially in the surface formed by the bottom of the sole, since in this way a roller skate which is built especially low and which is accordingly stable against tilting can be implemented.

In accordance with another preferred development, the rollers are supported on the sole such that the axes of rotation of the rollers are adjustable around swivel axes which run essentially vertically in the sole. By means of corresponding alignment of the axes of rotation of all rollers, it becomes possible to compensate for inside or outside rotary mispositioning of the foot in the area of the axis of the leg, such as the ankle joint axis, knee joint axis or hip joint axis. For individual adaptation it is necessary that the slanted position of the rolling directions of the rollers can be adjusted with respect to the longitudinal extension of the shoe and can be fixed in the optimum swivel position.

One structurally simple solution of the aforementioned swivelling capacity results from integrating into the sole rotary disk-like roller bearings which are adjustable around swivel axes which run essentially perpendicular to the bottom of the sole and which support the rollers to pivot around axes of rotation which run essentially parallel to the bottom. In doing so, the roller bearings are supported especially stiffly in the sole, such that additional fixing means to lock the roller bearing in a desired swivel position can be omitted.

It is also beneficial to a natural progression of motion if the rear roller is located essentially underneath and shortly in front of the rear bottom end of the heel bone of the foot to be accommodated by the shoe. In particular the rear roller is located essentially in the middle with respect to the transverse extension of the rear sole section. Furthermore, at least one of the front rollers can turn only in one direction and locks in the other direction.

By movements in the forefoot and rear foot area, the load of the individual rolling surfaces can be made selective. The rolling motion of the roller skate according to the invention can be controlled by the musculature of the feet. This is a therapeutic effect which is effective for correction of the pes planovalgus deformity.

The rollers in the sole sections are arranged such that a rolling surface is formed in the area of the forefoot and in the area of the rear foot, which in any case is so stable that no equilibrium problems arise. Thus, especially safe rolling is possible, so that even young children can use the roller skates according to the invention. In this case, the rollers are made in a special way. The at least one of the front rollers can turn only in one rolling direction while it locks in the other direction. In this way, only rolling in the forward direction is possible; however, pushing off, therefore accelerating, is very simple due to the locking of the rollers so that the forward rolling motion has great similarities to normal walking in the forward direction.

Furthermore, the rear rollers in the rear foot area can be provided dynamically with a braking effect according to the invention. This is ensured by the fact that the rear rollers have a rolling resistance which is dependent on the weight load, the rear rollers rolling free below a weight load threshold and having increased rolling resistance above this weight load threshold. This means that at overly heavy loading of the rear foot a braking action is formed, and on the other hand, that at lighter loading of the rear foot, for example, half the total load, free rolling is possible. Thus, while moving, loading of the front foot is obtained, while settling of the rear foot in the shoe is prevented. In this way, the musculature of the foot which stabilizes the arch is strengthened. In particular, the flexors (crural flexor, foot flexor) are strengthened in a controlled manner.

During braking, in turn, the forefoot must be raised to load the rear rollers more heavily, and to thus cause the braking action. In this way, the extensors are strengthened to an especially high degree. In addition the posture during free rolling corresponds to the posture in Alpine skiing, and thus, leads additionally to ideal strengthening of the entire leg and trunk musculature. The roller skate is, thus, also suited as an ideal training instrument for cross country skiing.

According to the invention, furthermore, the weight load threshold can be adjusted for the rear rollers, so that the braking action can be adjusted depending on the weight and training.

Finally, in the roller skate according to the invention, the use of a half-shoe is advantageous since much greater mobility of the foot is possible with it. This is used additionally for training of the foot muscles, and thus, enhances therapeutic possibilities, since control of the roller skate is thus possible more strongly from the foot and not only from the thigh and crural muscles. The danger of twisting with this roller skate is low since the rollers form gliding surfaces, not merely gliding lines, in the area of the support surfaces of the forefoot and rear foot, and since the center of gravity is low.

Tests have shown that the natural rolling motion is supported especially by the front sole section being raised towards the front end with respect to the skating surface defined by the front and rear rollers by an angle in the unloaded state, this angle being preferably a maximum of 25°.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
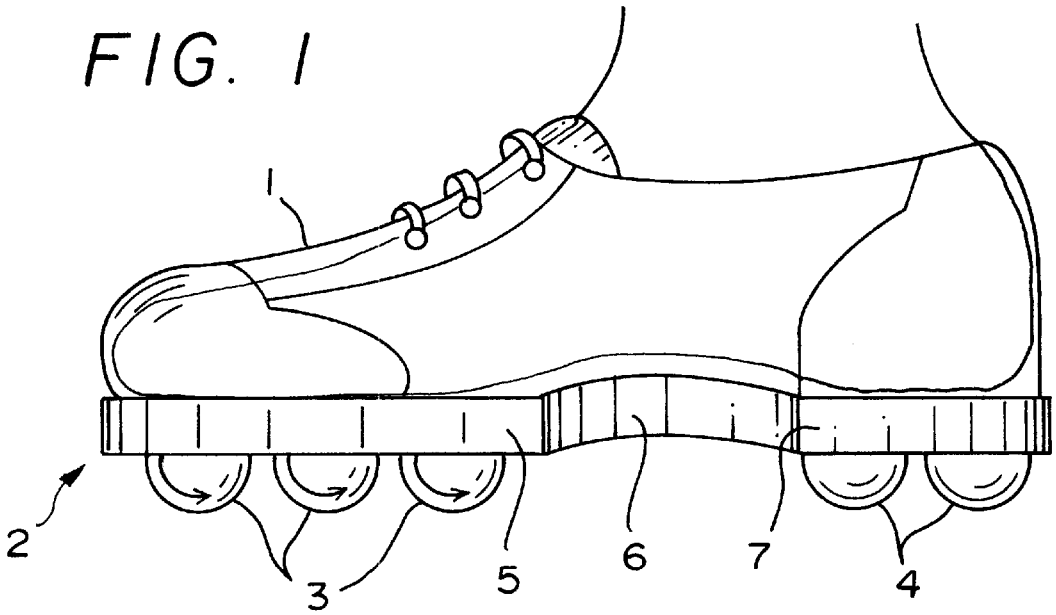
FIG. 1 shows in a side view of one embodiment of the roller skate according to the invention.

FIG. 1 shows a side view of an embodiment of a biodynamic roller skate which has shoe 1 with a sole 2. In the area of the forefoot of this roller skate, front rollers 3 are arranged such that they collectively form a glide surface. Similarly, in the rear foot area of the sole there are rear rollers 4 which collectively form a gliding surface. Sole 2 has three sections, specifically, a rigid front sole section 5, a more flexible center sole section 6 and a rigid rear sole section 7. The terms rigid and flexible, of course, should not be understood in absolute terms. Here, the definition of sole rigidity applicable to shoes in general should be applied. Otherwise, it is also clear that the flexible middle sole section will frequently be formed only by a flexible strip which is immediately adjacent to the front sole section, so that the angular position between the front and rear sole section is accomplished on a relatively short piece of the sole. This is also conventional in athletic shoes. Otherwise a correspondingly narrow flexible strip also often occurs by itself even if the middle sole section is wider and flexible overall.

Similar to a normal shoe, therefore, the front sole section 5 and the rear sole section 7 can move relative to one another since flexible center sole section 6 makes it possible for front sole section 5 and rear sole section 7 to assume different angles to one another depending on the load of the shoe.

The different sole sections 5, 6 and 7 of the roller skate are now made as follows. Front sole section 5 is essentially matched to the support surface of the forefoot, so that the front sole section 5 completely supports the forefoot. Likewise, the rear sole section 7 is essentially adapted to the support surface of the rear foot, so that rear sole section 7 supports the rear foot. Front sole section 5, on the bottom, forms a flat surface, so that front rollers 3 can be distributed in front sole section 5 such that they collectively form a glide surface (i.e., in contrast to conventional skates where a single line of support is formed by a pair of coaxially arranged rollers, the offset arrangement of the rollers provide multiple lines of support which together with the flat sole provide for the foot what is called here to be a glide surface). Similarly, the rear sole section 7 has a flat surface on the bottom in which rear rollers 4 are arranged to form multiple lines of support. In the embodiment shown, the glide surfaces formed by rollers 3 and 4 are roughly as large as the respective bottoms of corresponding sole section 5, 7. However, this need not necessarily be so. In principle, for flat support of the forefoot and rear foot in the front foot area, three rollers which are arranged in a type of triangle or possibly even two rollers are enough as in a normal roller skate, in the rear foot area two rollers or one especially wide single roller which likewise has a flat action are adequate.

Figure 2:
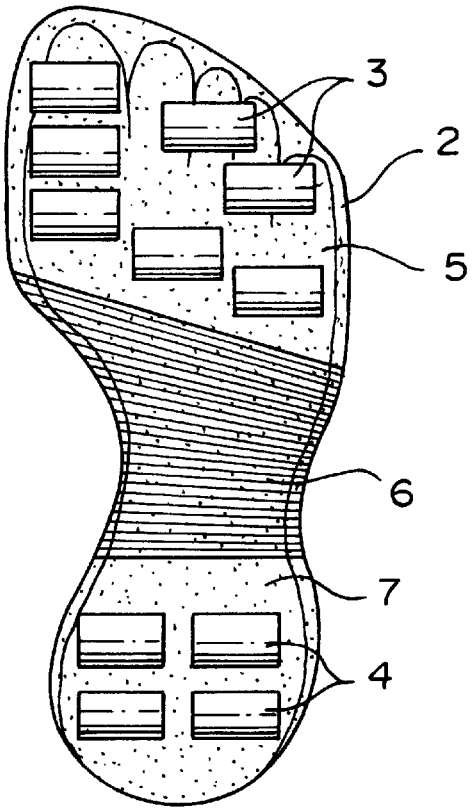
FIG. 2 is a bottom view of the roller skate shown in FIG. 1.

As can, likewise, be recognized in FIG. 2, the shape of flexible middle sole section 6 is matched to the shapes of front sole section 5 and rear sole section 7, so that all sole sections 5, 6 and 7 together form a continuous sole 2.

As shown in FIG. 1, in the preferred embodiment, flexible middle sole section 6 is arched upward so that middle sole section 6 produces a shape which is matched to the foot. However, it is, likewise, possible to configure the middle sole section 6 as a flat section, so that the bottom surfaces of front sole section 5, flexible middle sole section 6 and rear sole section 7 essentially lie in one plane in the unloaded state.

Figure 3A:
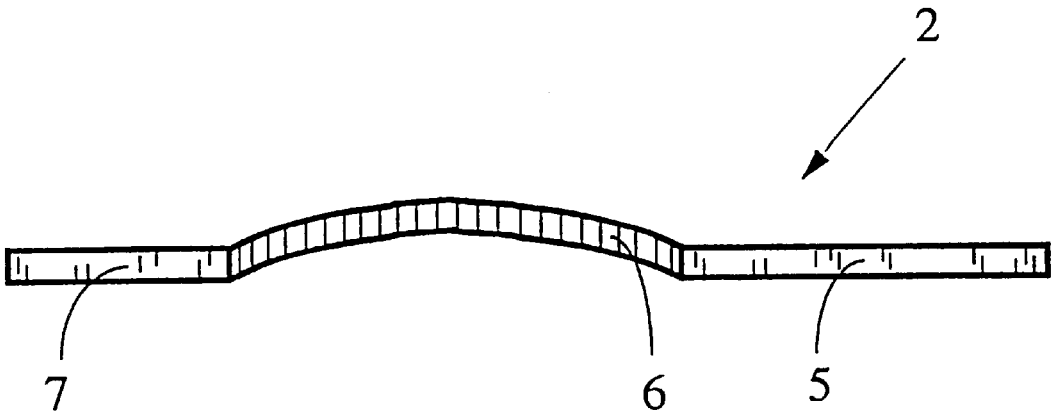
FIGS. 3*a*–3*c* schematically show the progression of movement of the sole formed of three sections while the roller skate is being used.
Figure 3B:
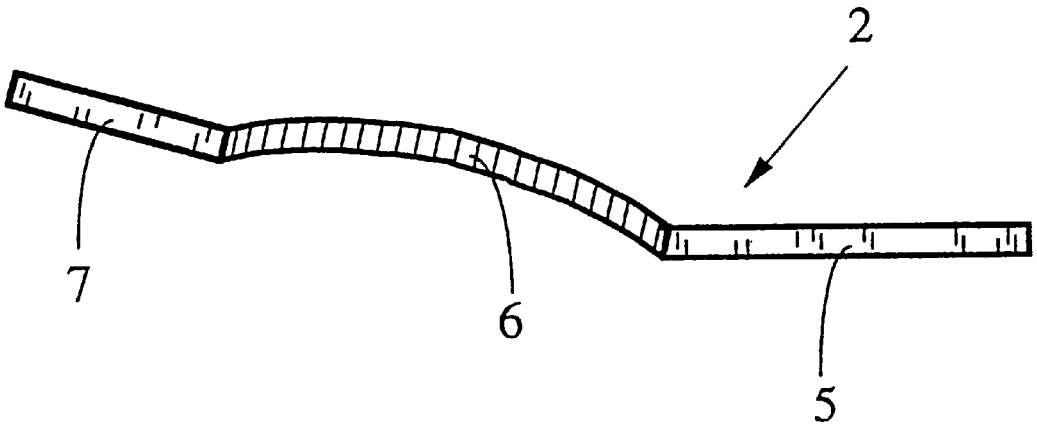
Figure 3C:
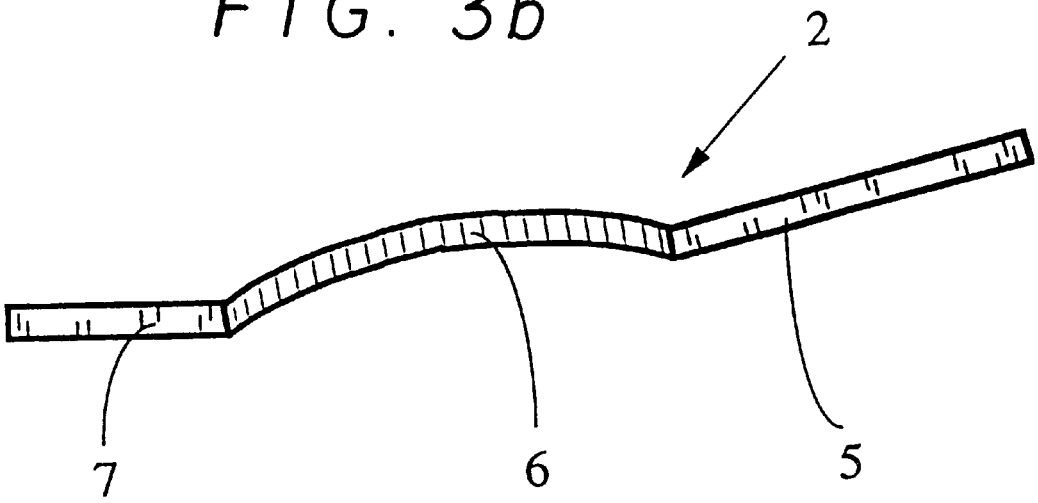
Figure 4A:
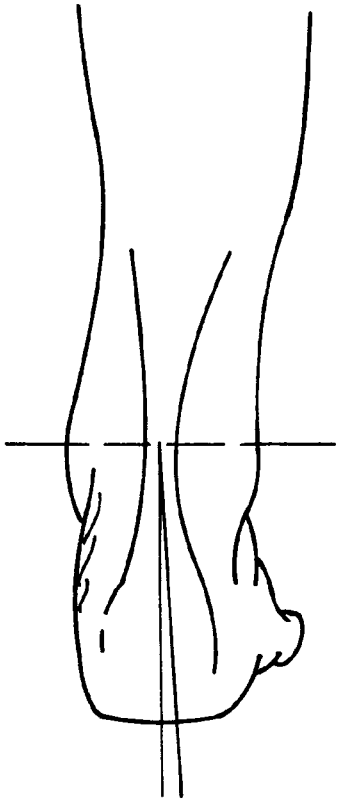
FIGS. 4*a* & 4*b* rear views of a right foot to illustrate the axis of the rear foot with and without the pes planovalgus deformity.
Figure 4B:
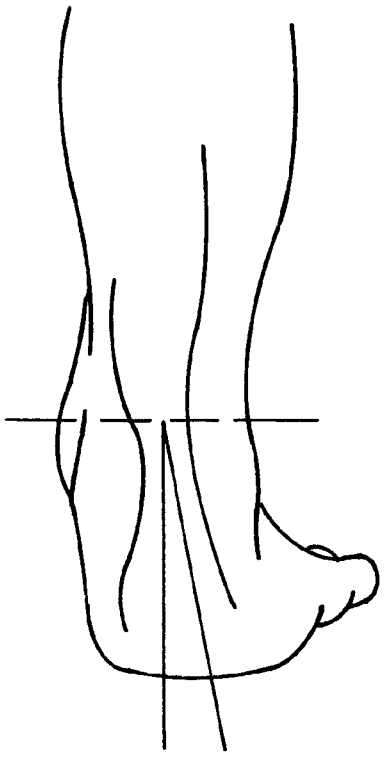

FIG. 3*a*–3*c* schematically show the three sole sections 5, 6, and 7 of sole 2 in the different stages of movement during gliding rolling. FIG. 3*a* shows sole 2 in the unloaded state or while standing, therefore, in a state in which front sole section 5 and rear sole section 7 are uniformly loaded making contact with the ground via the rollers (which are not shown in this figure). FIG. 3*b* shows the arrangement of sole sections 5, 6 and 7 in a state in which only front sole section 5 is loaded. This state occurs when during pushing off to the rear takes place. In doing so, the advantageous action of flexible middle sole section 6 becomes especially apparent since, as in walking in normal shoes, rear sole section 7 is raised, while front sole section 5 is largely in contact with the ground. At the same time, at least roller 3 in front sole section 5 is locked against turning backwards. This means that gliding with the roller skate according to the invention enables similar movement as is the case when walking in normal shoes. Finally, rear sole section 7, in the arrangement of sole sections 5, 6 and 7 shown in FIG. 3*c*, has contact with the ground, while the front sole section 5 is raised. This posture is assumed, especially, when the roller skate brakes as is described in detail in the following.

In the roller skate according to the invention, therefore, the gliding movement approximates the motion of walking in a normal shoe. In comparison, with the roller skates known from the prior art in which the front rollers can turn in both directions, pushing off, therefore accelerating, is possible only by twisting the foot to the outside, similar to use of ice skates by ice hockey players. With the configuration of front rollers 3, thus pushing off to the front is possible in such a way as is possible, for example, with ice skates which are used for figure skating, which have runners with serrations on the front end which enable pushing off to the front without twisting the foot to the outside.

Rear rollers 4, here, have a rolling resistance which depends on the weight load. In this case, rear rollers 4 roll freely below a weight load threshold; however, they have an increased rolling resistance above the weight load threshold. In this way, a uniform distribution of the weight load on the forefoot and the rear foot is obtained during roller gliding.

As has been described above, one reason for the pes planovalgus deformity is that the rear foot is loaded too heavily and the forefoot too weakly. If, now, rear rollers 4 are configured such that they have increased rolling resistance above a weight load which corresponds, for example, to 50% of the total weight load and thus brake, a skater is forced to more heavily load the forefoot and the unload the rear foot in order to roll forward without hindrance. As has been described above, in this way, strengthening of the arch-stabilizing foot musculature is produced. By means of a corresponding weight load on the rear foot, conversely, a braking process can be caused without, for example, the need to twist the foot to the outside to produce a dragging of the rollers over the ground as a brake. Basically, other braking means can be accomplished, for example, the brake pads known in standard roller skates on the rear edge of the rear foot area can be used.

The entire process of movement during roller gliding is largely adapted to the process of motion when walling in normal shoes, since as in normal walking, twisting of the foot to the outside, whether to push off or brake, is prevented. In addition, proper loading of the forefoot and rear foot by the rolling properties of rear rollers 4 is obtained. Therefore, the roller skate according to the invention is especially suited for therapeutic treatment of pes planovalgus.

Figure 5:
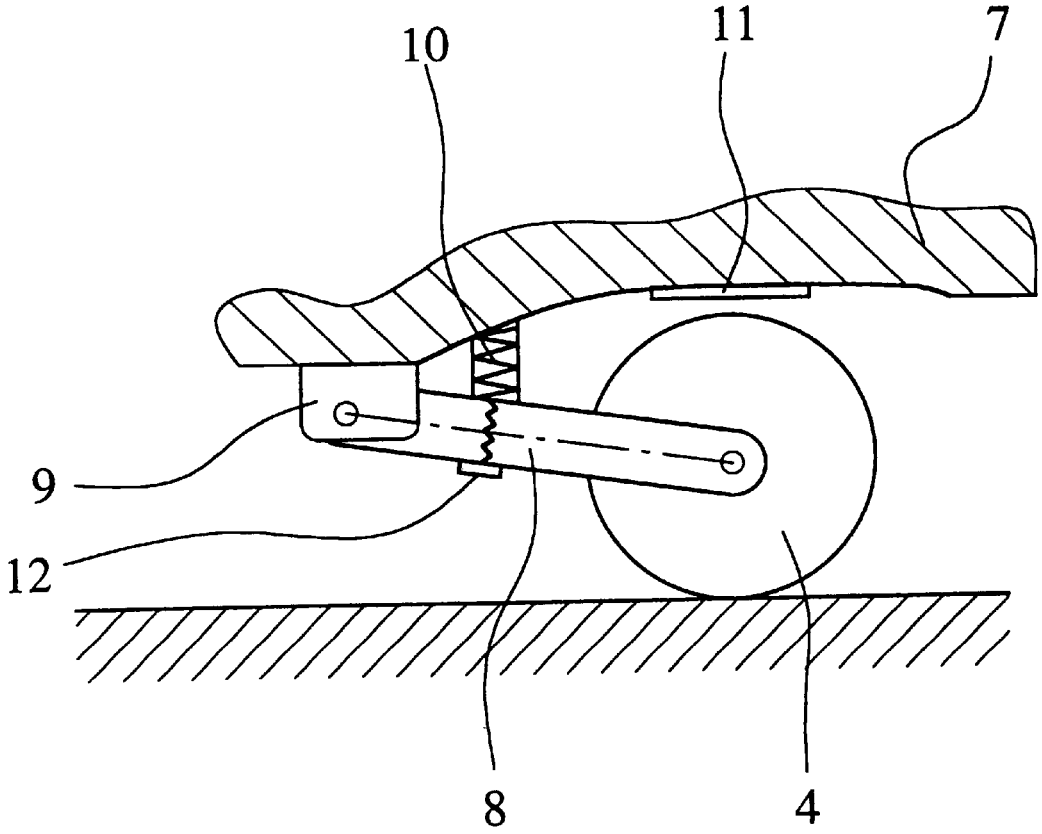
FIG. 5 shows a weight-responsive roller mounting arrangement.

In one special embodiment, shown in FIG. 5, the distance between rear rollers 4 and rear sole section 7 is variable, the distance being adjusted depending on the weight load. For this reason, there is a spring between the rear rollers 4 are mounted to the rear sole section 7 via a swing arm 8 and a pivot bearing. Between the swing arm 8 and the sole section 7 is an elastic element 10 in the form of a rubber cushion or a cushion of another elastic material. Here, can also be used another type of elastic element, such as a compression spring. Depending on the weight load, a change of the distance between the rear rollers 4 and rear sole section 7 is produced by compression and expansion of the elastic element 10. In this way, a reduction of the distance of rear rollers 4 to rear sole section 7 above the weight load threshold is possible to such an extent that rear rollers 4 rest against friction surfaces 11. The friction produced in this way, increases the rolling resistance of rear rollers 4 so that braking occurs.

Furthermore, in the FIG. 5 embodiment, the distance between the rear rollers 4 and rear sole section 7 is adjustable using a setting screw 12 seated in the swing arm 8. By adjusting the position of the setting screw 12, the bottom point of the elastic element 10 is changed, so that the distance between the rear rollers 4 and the rear sole section 7 is changed. As a result, the weight load threshold can be easily adjusted so that depending on the weight and training state of the skater being treated, the braking properties of rear rollers 4 can be adjusted. A weight scale (not shown) can be associated with the screw 12, which enables a reproducible setting of the weight load threshold.

In the embodiment of the roller skate shown in FIG. 1, the shoe 1 is made as a half shoe (i.e., has a low top upper which terminates below the ankle area) since the danger of twisting during roller gliding is greatly reduced due to the low center of gravity which is caused by the arrangement of rollers 3 and 4 in sole 2 and due to the large glide surfaces caused by the distribution of rollers 3 and 4, so that special support of the foot joint is unnecessary. When a half shoe is used, however, greater mobility of this foot is caused; this in turn counteracts the motion therapy of the foot. Of course, the shoe can also be made such that it extends above the ankle joint in order to support it (i.e, using a high top upper of the top conventional for standard shoe and ice skates).

Figure 6:
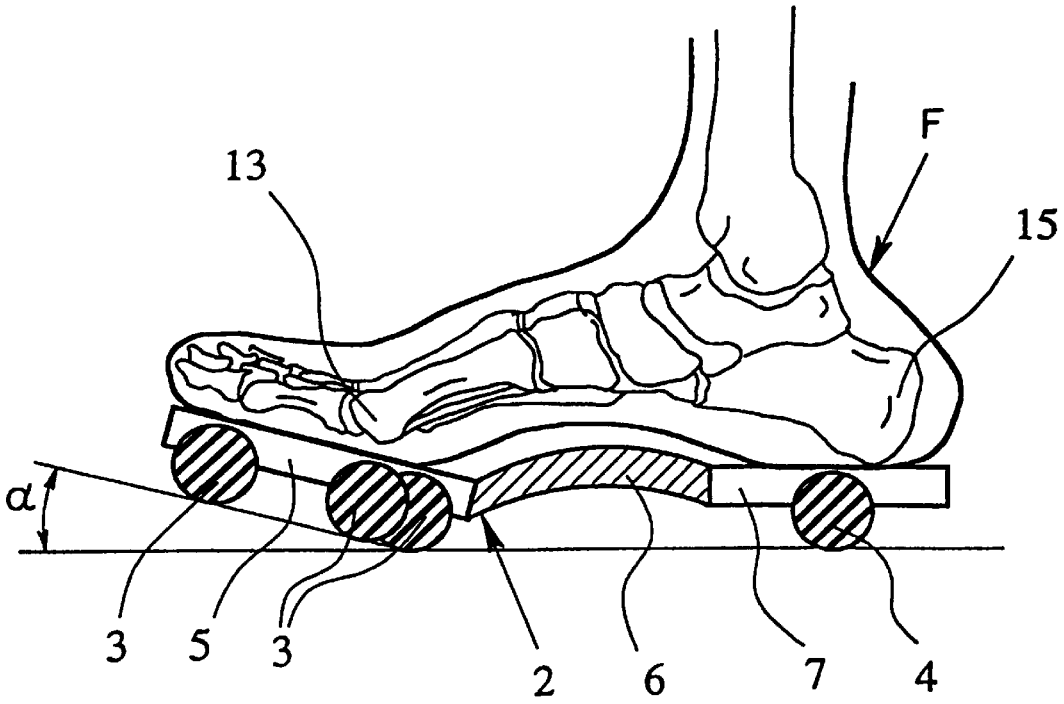
FIG. 6 is a schematic side view of the skate sole of FIG. 1 with a foot thereon, and showing the orientation of the sole when the forefoot area has been unloaded.

FIG. 6 shows a side view another embodiment of the roller skate according to the invention which has, like that described above, a shoe 1 with a sole 2 with front rollers that form a gliding surface in the area of the rigid forefoot section 5 and rear rollers 4 that form a gliding surface in the area of the rigid rear section 7, the front and rear sections being connected by a flexible center section 6. However, in this case only three front rollers 3 and only two rear rollers 4 are provided.

The flexible center section 6 makes it possible for the front sole section 5 and the rear sole section 7, depending on the load of the shoe, to assume different angles relative to one another. In particular, the roller skate according to this embodiment of the invention is designed such that the front sole section 5 in a substantially unloaded state, e.g., when the wearer of the roller skate is standing at rest, is slightly raised towards the front end of the roller skate by an angle $\alpha$, as shown in FIG. 6. This angle $\alpha$ with respect to the skating surface defined by a plane containing at least one rear roller 4 and a rearmost of said front rollers 3, or with respect to the floor or ground, is preferably a maximum 25°. By this raising of the roller skate in its front area, the natural rolling. behavior of a foot wearing a roller skate is ideally supported.

The different sole sections 5, 6 and 7 of the roller skate are now made as follows. Front sole section 5 is essentially matched to the support surface of the forefoot so that the front sole section 5 completely supports the forefoot. Likewise, rear sole section 7 is essentially adapted to the support surface of the rear foot so that rear sole section 7 supports the rear foot. The bottom of front sole section 5 forms a flat surface into which front rollers 3 are partially recessed and are distributed over the surface such that front rollers 3 form an essentially triangular gliding surface. Similarly, the two rear rollers 4 are recessed into the rear sole section 7 which, likewise, has a flat bottom surface. As can also be recognized in FIG. 6, the shape of flexible middle sole section 6 is matched to the shapes of the front sole section 5 and rear sole section 7 so that all of the sole sections 5, 6 and 7, together, form continuous sole 2.

As shown in FIG. 6, in this preferred embodiment, the flexible middle sole section 6 is arched upward so that middle sole section 6 produces a shape of entire sole 2 which is matched to the foot. It is however likewise possible to configure middle sole section 6 as a flat section so that the bottom surfaces of front sole section 5, flexible middle sole section 6 and rear sole section 7 in the unloaded state essentially lie in one plane.

As with the previous embodiment, at least one of the front rollers 3 can rotate only in a forward skating direction so that pushing off to the front is possible is enabled without twisting the foot to the outside in a manner comparable to that, for example, with ice skates for figure skating that have runners with serrations on the front end. Also, the rear rollers 4 in this preferred embodiment have a rolling resistance which depends on the weight load as was described above relative to FIG. 5.

As has been described above, one reason for the pes planovalgus deformity is that the rear foot is loaded too heavily and the forefoot too weakly. If now rear rollers 4 are configured such that they have increased rolling resistance above a weight load which corresponds, for example, to 50% of the total weight load and thus brake, a skater is forced to more heavily load the forefoot and the unload the rear foot in order to roll forward without hindrance. As has been described above, in this way strengthening of the arch-stabilizing foot musculature is produced. By means of a corresponding weight load on the rear foot conversely a braking process can be caused without, for example, the need to twist the foot to the outside and a resulting dragging of the rollers over the ground as the brake. Basically, other braking means can be implemented, for example, the brake pads known in standard roller skates on the rear edge of the rear foot area.

The entire process of movement during skating is largely adapted to the progression of motion when walking in normal shoes, since as in normal walking twisting of the foot to the outside, whether to push off or brake, is prevented. In addition, proper loading of the forefoot and rear foot by the rolling properties of rear rollers 4 is induced. Therefore the roller skate according to the invention is especially suited for therapeutic treatment of pes planovalgus.

Figure 7A:
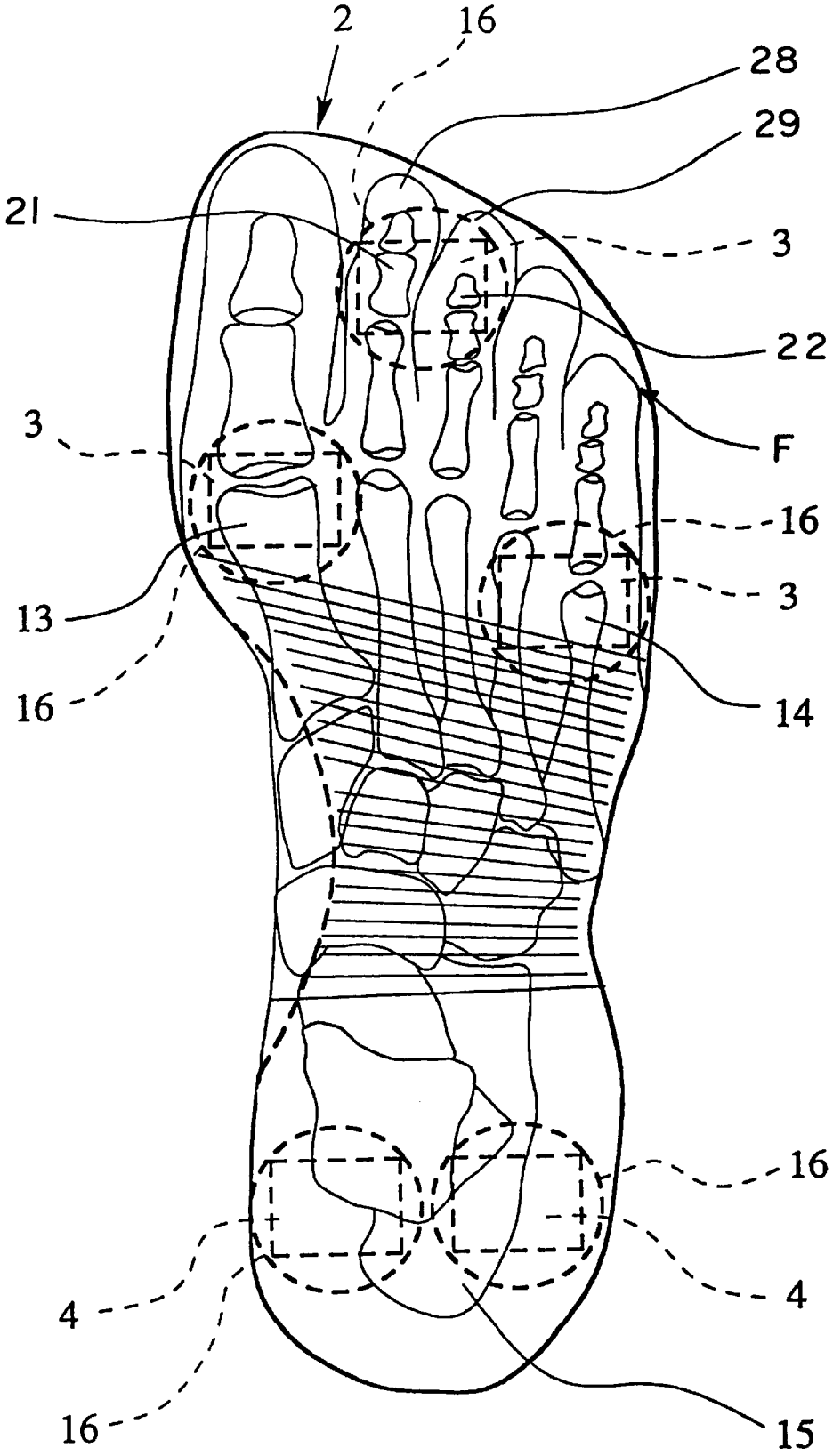
FIG. 7*a* is a plan view of the skate sole as shown in FIG. 6, depicting a preferred arrangement of rollers of an alternative skate embodiment relative to the bones of a foot received in the shoe of the skate.
Figure 7B:
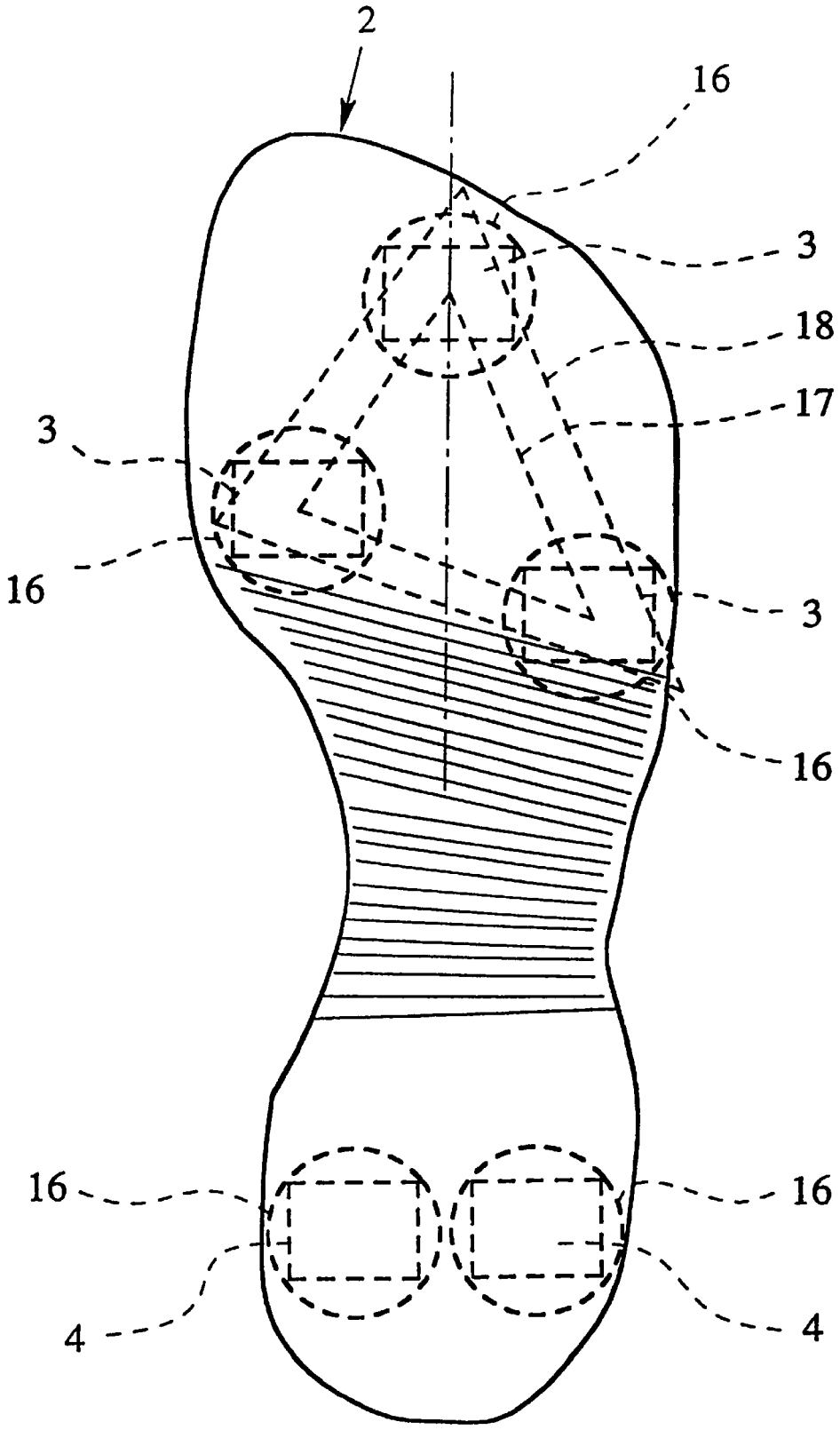
FIG. 7*b* is a plan view of a sole of a skate having rollers positioned in accordance with FIG. 7*a* with the foot omitted and illustrating the triangular sliding surface.
Figure 7C:
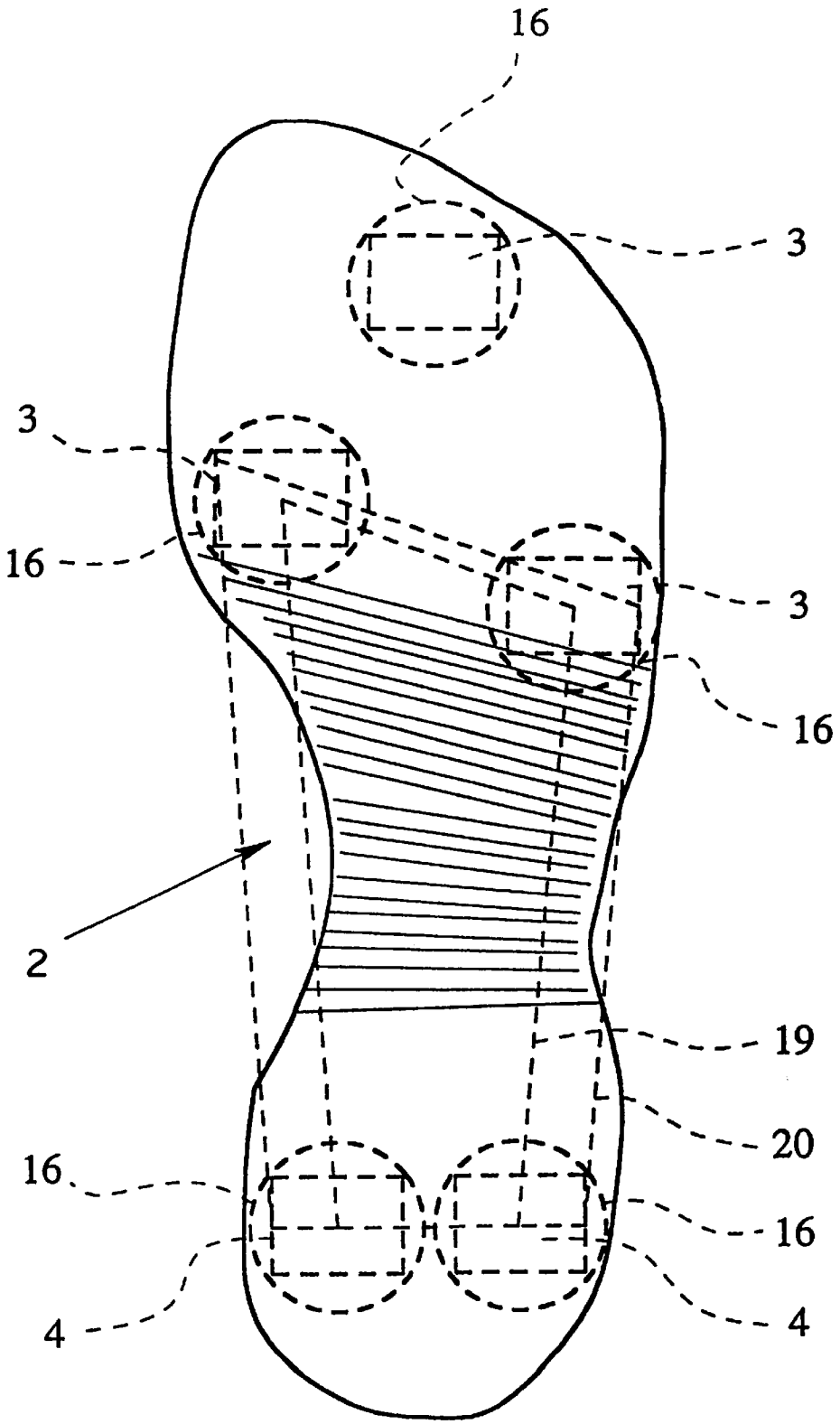
FIG. 7*c* is a plan view similar to that of FIG. 7*b*, but illustrating the trapezoidal sliding surface formed by the rear rollers of the forefoot area of the sole and the rollers of the rear area of the sole.
Figure 7D:
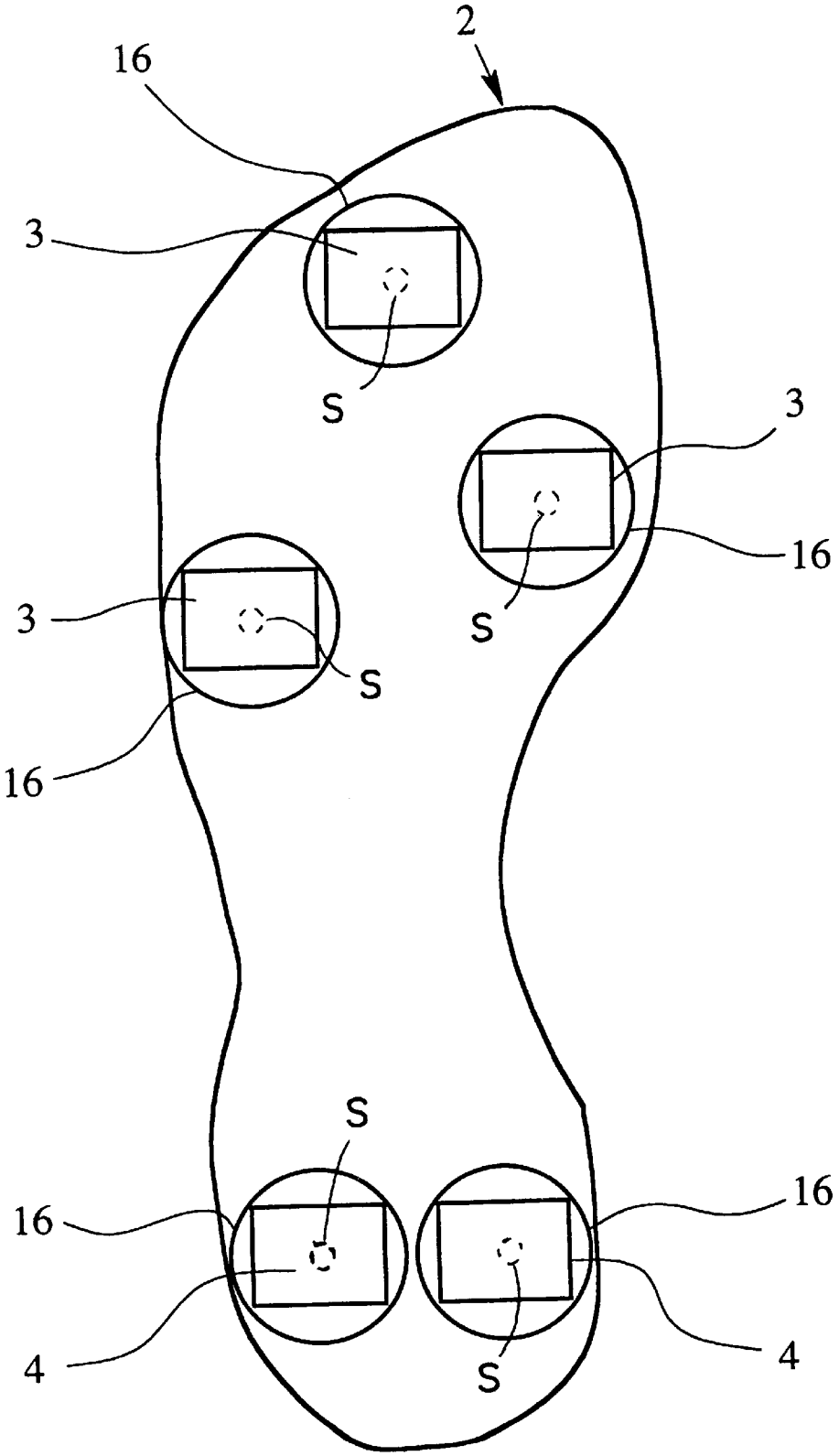
FIG. 7*d* is a bottom view of a sole of a skate having rollers positioned in accordance with FIG. 7*a* showing the disk-shaped bearings and the virtual axes about which they swivel.

As can best be seen from the plan view of the roller skate according to the invention shown in FIG. 7*a* without the shoe upper and in the bottom view of FIG. 7*d*, rollers 3, 4 are each held on the bottom of sole 2 in rotary disk-shaped roller bearings 16. Here, the annular roller bearings 16 are integrated into sole sections 5 and 7 such that roller bearings 16 can each be swivelled around virtual axes S that represented by broken circles in FIG. 7*d* and which run essentially perpendicularly to the bottom of sole sections 5 and 7. Each roller bearing 16, in the example, bears a roller 3 or 4 with an axis of rotation essentially parallel to the indicated sole bottom. Thus, by swivelling roller bearings 16 in sole 2, the skating direction of the roller skate is securely established. This adjustment capacity enables compensation for inside or outside rotary mispositioning in the area of the axis of leg, such as the ankle joint axis, knee joint axis or hip joint axes by corresponding alignment of the skating direction of the skate with respect to its longitudinal extension.

In the embodiment of the roller skate shown in FIG. 6, shoe 1 is, again, made as a half shoe since due to the low center of gravity which is caused by the arrangement of rollers 3 and 4 in the sole 2 and due to the large gliding surfaces caused by the distribution of rollers 3 and 4, the danger of twisting during skating is greatly reduced so that special support of the foot joint is unnecessary. When a half shoe is used however greater mobility of this foot is caused than in a shoe which surrounds the ankle; this in turn counteracts the motion therapy of the foot. Of course, the shoe can also be made such that it extends upwardly beyond the foot joint in order to support it.

Another important aspect of the proposed roller skate can be seen in the arrangement of rollers 3, 4 on the bottom of sole 2 or respective sole sections 5 and 7. Reference is made especially to FIGS. 7*a*–7*d* to illustrate this special configuration below.

FIG. 7*b* especially clearly shows that three front rollers 3 are distributed triangularly on the bottom of sole section 5. Here, rollers 3 define an essentially triangular gliding surface 18 in which each of the rollers are arranged longitudinally and laterally offset relative to one another. Since, in the example shown, the axes of rotation of rollers 3 and 4 run essentially parallel to the sole bottom and are aligned preferably parallel to one another on or in sole 2 or sole sections 5, 7, a skating direction of the roller skate which runs essentially in the direction of the longitudinal extension of shoe 1 is fixed, and with respect to this skating direction, three front rollers 3 are located offset to one another both lengthwise and transversely. Furthermore, the essentially triangular gliding surface 18, based on the arrangement of three front rollers 3 on the corners of triangle 17, is fixed such that glide surface 18 forms a tip which is pointed forward and which is truncated according to the width of frontmost roller 3. Based on the aforementioned longitudinal offset of the front rollers 3, it goes without saying that the triangle 17 formed by rollers 3 is not mirror-symmetrical with respect to the skating direction or longitudinal extension of the roller skate.

The aforementioned frontmost roller 3 which forms the tip of triangle 17 according to this preferred embodiment is located essentially underneath the second and third toes 28, 29 of foot F received in the shoe 1 of the roller skate; here, this roller 3 is located relatively near the distal end of the two aforementioned toes 28 and 29 and especially in the area of the second middle toe bone 21 and in the area of third distal toe bone 22. Thus, frontmost roller 3 lies essentially in the longitudinally running center axis of shoe 1 or the roller skate.

As already mentioned, the rear pair of front rollers 3 which form the other two corner points of triangle 17 are, likewise, offset in the direction of the skating motion of the roller skate, the medial (inner) roller 3 lying farther forward with respect to the skating direction and the lateral (outer) roller 3 conversely farther to the rear. Thus, a slanted rear edge of gliding surface 18 is established by these two rollers 3 in the sole plane with respect to the skating direction. In particular, the rear pair of front rollers 3 are located on the bottom of sole section 5 essentially underneath the first metatarsal capitulum 13 and fifth metatarsal capitulum 14, therefore, in the areas underneath the distal ends of the first and fifth middle foot bone of foot 10 received by the shoe 1, the upper of which is not shown in FIGS. 6 and 7*a*–7*c*, but which corresponds to that shown in FIG. 1. Thus, the medial side one of the rear pair of front rollers 3 is located essentially underneath the ball of foot 10.

This arrangement of the front rollers 3, optionally with glide surface 18 defined by three front rollers 3, or with additional rollers as in the first embodiment, which yields a greatly optimized rolling behavior of the roller skate since the forefoot area can accomplish the motion which is natural in running or walking in an especially natural way. The good rolling properties are accordingly achieved in a roller skate with the aforementioned three sole sections 5, 6 and 7 by front rollers 3 which are located on front sole section 5 being distributed over the area of bottom of this sole section 5 such that they establish an essentially triangular gliding surface 18 with a tip which points forward, the rear edge of glide surface 18 running at an angle to the skating direction that runs forwardly from the lateral side toward the medial side of the sole.

Furthermore, a progression of motion which is especially pleasant for the user is achieved when the roller skate according to the invention has only two rear rollers 4 that are located with their axes of rotation in alignment with each other. This results in the there gliding surface not being extended on the rear sole section 7, but rather the contact area between the roller skate and ground which is defined by rear rollers 4 is more or less only linear. This formation of a more or less uniaxial support which is to be implemented by a corresponding aligned arrangement, as compared to a rear gliding surface which is extended in the skating direction, leads to the advantage that the rear sole section 7 can be swivelled more easily around the axis of rollers 4 while seated in contact with the ground. This supports an especially natural progression of motion. However, the use of more than two aligned rear rollers 4 (as in the first embodiment) or only one rear roller 4 is still suitable.

FIG. 6 shows that the axes of rotation of the rear rollers 4 are located slightly offset to the front in the vicinity of the rear lower end of ankle bone 15 of foot F and especially in this regard. This position has proven especially advantageous for high wearing comfort of the roller skate and a progression of motion is therapeutically optimum when the roller skate is being used.

Furthermore, it should be pointed out that, as is best seen in FIG. 7*c*, rear rollers 4, together with the rear pair of front rollers 3 define an essentially trapezoidal gliding surface 20 based on the distribution of these rollers 3, 4 on the bottom of sole 2 at the corner points of a trapezoid 19. This gliding surface 20 determines the rolling behavior of the roller skate according to this embodiment of the invention when the front sole section 5 raised to the front, therefore, especially in the substantially unloaded state, if a user wearing the roller skate stands loosely or skates along without a major expenditure of force.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Biodynamic roller skate comprising a shoe having a sole, a plurality of front rollers located in a forefoot area of the sole and a plurality of rear rollers located in a rear foot area of the sole; wherein a front sole section encompassing said forefoot area of the sole is rigid; wherein a rear sole section encompassing said rear foot area of the sole is rigid; wherein a flexible middle sole section is connected between the rigid front sole section and the rigid rear sole section; wherein at least one of the front rollers is rotatable in only one rotational direction, locking in an opposite rotational direction; and wherein at least a majority of the rollers in the forefoot area is each offset relative to adjacent rollers in both transverse and longitudinal directions of the sole in a manner adapted to match the location of support surfaces of a sole of a wearer's foot in use.

2. Roller skate according to claim 1, wherein the front rollers are distributed over the forefoot area in a manner creating multiple lines of support which, together with the rigid front sole section, provides a supporting glide surface for a wear's foot; and wherein the rear rollers are distributed over the rear foot area in a manner creating multiple lines of support, which together with the rigid front sole section, provides a supporting glide surface for the wear's foot.

3. Roller skate according to claim 1, wherein the flexible middle sole section has an upwardly arched shape.

4. Roller skate according to claim 1, wherein the flexible middle sole section is formed only by a flexible bending strip which is directly adjacent to the front sole section.

5. Roller skate according to claim 1, wherein said majority of rollers comprises at least three rollers that are offset transversely and longitudinally relative to adjacent rollers.

6. Roller skate according to claim 1, wherein the rear rollers are provided with a means for varying a rolling resistance of the rear rollers in dependence on a weight load on the rear rollers.

7. Roller skate according to claim 6, wherein said means for varying enables the rear rollers to roll freely below a weight load threshold and to have an increased rolling resistance above said weight load threshold.

8. Roller skate according to claim 7, wherein said rear rollers are at a distance from the rear section of the sole and said means for varying includes means for changing the distance between the rear rollers and the rear sole section.

9. Roller skate according to claim 8, wherein said means for changing the distance between the rear rollers and the rear sole section is weight load responsive.

10. Roller skate according to claim 9, wherein said means for changing comprises an elastic element between each rear roller and the rear sole section.

11. Roller skate according to claim 10, wherein a friction surface is provided on an underside of the rear sole section, the rear rollers engaging said friction surface above said weight load threshold.

12. Roller skate according to claim 1, wherein said rear rollers are at a distance from the rear section of the sole and means for changing the distance between rear rollers and the rear sole section is provided.

13. Roller skate according to claim 12, wherein said means for changing the distance between the rear rollers and the rear sole section is weight load responsive.

14. Roller skate according to claim 13, wherein said means for changing comprises an elastic element between each rear roller and the rear sole section.

15. Roller skate according to claim 14, wherein a friction surface is provided on an underside of the rear sole section, the rear rollers engaging said friction surface above a weight load threshold.

16. Roller skate according to claim 15, wherein a set screw means is provided for adjusting the distance of the rear rollers relative to the rear sole section and thereby the weight load threshold.

17. Roller skate according to claim 14, wherein a set screw means is provided for adjusting the distance of the rear rollers relative to the rear sole section and thereby the weight load threshold.

18. Roller skate according to claim 1, said shoe has a low top upper which will not extend above an ankle area of a wearer's foot in use.

19. Roller skate according to claim 1, wherein said sole sections are formed in a manner causing the front sole section to be angled upwardly in a forward direction at an angle of at most about 25° relative to a plane containing a skating surface of at least one rear roller and a rearmost of said front rollers when the sole is in a substantially unloaded state, in a manner causing rollers forward of the rearmost of said front rollers to be raised above said plane.

20. Roller skate comprising a shoe with a sole having a fore foot area with a rigid front sole section to a bottom of which front rollers are mounted, and having a rear foot area with a rigid rear sole section to a bottom of which at least one rear roller is mounted and having a flexible middle sole section between said rigid front and rear sole sections; wherein the front rollers on the bottom of the front sole section are distributed in a pattern generally defining a triangular skating surface, a tip of which points in a forward direction and is defined by a one of the front rollers which is positioned in a manner adapted to be located in use essentially under a second and third toe of a foot which is to be received in the shoe; wherein two other of the front rollers are positioned in a manner adapted to be located in use essentially under first and fifth metatarsal capitulum of the foot to be received in the shoe, said two other front rollers define a rear edge of the skating surface which is angled forwardly and rearwardly relative to a longitudinal axis of the shoe in a plane of the sole.

21. Roller skate according to claim 20, wherein the front roller which defines the tip is positioned in a manner adapted to be located in use under the second middle toe bone and third distal toe bone of the second and third toe of a foot to be received in the shoe.

22. Roller skate according to claim 21, wherein rotary disk-shaped roller bearings are integrated into the sole which are displaceable around swivel axes which run essentially perpendicular to the bottom of the sole and which support the rollers which turn around axes of rotation which run essentially parallel to the bottom of the sole.

23. Roller skate according to claim 20, wherein there are only three front rollers.

24. Roller skate according to claim 20, wherein the front roller which defines the tip is positioned in a manner adapted to be located in use in the middle between said other front rollers and said at least one rear roller with respect to a direction transverse to the longitudinal axis of the roller skate.

25. Roller skate according to claim 20, at least one of the front rollers is rotatable in only one direction.

26. Roller skate according to claim 20, wherein the front and rear rollers are integrated into the sole so that axes of rotation of said front and rear rollers lie essentially in the plane of the sole.

27. Roller skate according to claim 20, wherein the rollers are mounted on the sole in a manner enabling the axes of rotation of rollers to be displaceable around swivel axes which run essentially perpendicular to the sole.

28. Roller skate according to claim 20, wherein the at least one rear roller is positioned in a manner adapted to be located in use essentially underneath and toward the front of the rear lower end of the heel bone of the foot which is to be received in the shoe.

29. Roller skate according to claim 20, wherein the at least one rear roller is located essentially in a transversely central portion of the rear sole section.

30. Roller skate according to claim 20, wherein a plurality of rear rollers are provided, all of the rear rollers being located next to one another.

31. Roller skate according to claim 30, wherein the rear rollers together with the two other front rollers define a trapezoidal sliding surface.

32. Roller skate according to claim 20, wherein said sole sections are formed in a manner causing the front sole section to be angled upwardly in a forward direction at an angle of at most about 25° above a plane containing a skating surface of the at least one rear roller and a rearmost of said front rollers when the sole is in a substantially unloaded state.

33. Roller skate comprising a shoe with a sole having a fore foot area with a rigid front sole section to a bottom of which front rollers are mounted, and having a rear foot area with a rigid rear sole section to a bottom of which at least one rear roller is mounted and having a flexible middle sole section between said rigid front and rear sole sections; wherein said sole sections are formed in a manner causing the front sole section to be angled upwardly in a forward direction at an angle of at most about 25° relative to a plane containing a skating surface of the at least one rear roller and a rearmost of said front rollers when the sole is in a substantially unloaded state, in a manner causing rollers forward of the rearmost of said front rollers to be raised above said plane.

* * * * *